US009752597B2

(12) United States Patent
Buschkopf et al.

(10) Patent No.: US 9,752,597 B2
(45) Date of Patent: Sep. 5, 2017

(54) METERED FLUID SOURCE CONNECTION TO DOWNSTREAM FUNCTIONS IN PCLS SYSTEMS

(71) Applicant: HUSCO International, Inc., Waukesha, WI (US)

(72) Inventors: Casey Buschkopf, Monona, WI (US); Darrell Hesse, Germantown, WI (US); Joseph L Pfaff, Wauwatosa, WI (US); Jacob Ballweg, Waukesha, WI (US); Eric P Hamkins, Waukesha, WI (US)

(73) Assignee: HUSCO International, Inc., Waukesha, WI (US)

( * ) Notice: Subject to any disclaimer, the term of this patent is extended or adjusted under 35 U.S.C. 154(b) by 177 days.

(21) Appl. No.: 14/854,755

(22) Filed: Sep. 15, 2015

(65) Prior Publication Data

US 2017/0074293 A1 Mar. 16, 2017

(51) Int. Cl.
*F15B 11/16* (2006.01)

(52) U.S. Cl.
CPC ..... *F15B 11/163* (2013.01); *F15B 11/162* (2013.01); *F15B 2211/30535* (2013.01); *F15B 2211/351* (2013.01); *F15B 2211/40507* (2013.01); *F15B 2211/40515* (2013.01); *F15B 2211/40569* (2013.01); *F15B 2211/41509* (2013.01); *F15B 2211/50554* (2013.01); *F15B 2211/5151* (2013.01); *F15B 2211/565* (2013.01); *F15B 2211/781* (2013.01)

(58) Field of Classification Search
CPC ..... F15B 11/163; F15B 11/162; F15B 2211/30535; F15B 2211/40561; F15B 2211/41509; F15B 2211/50554; F15B 2211/565
See application file for complete search history.

(56) References Cited

U.S. PATENT DOCUMENTS

| | | | | |
|---|---|---|---|---|
| 4,693,272 | A | 9/1987 | Wilke | |
| 5,579,642 | A | 12/1996 | Wilke et al. | |
| 5,950,429 | A * | 9/1999 | Hamkins | F15B 11/162 60/422 |
| 7,818,966 | B2 * | 10/2010 | Pack | F15B 11/163 60/422 |
| 8,215,107 | B2 * | 7/2012 | Pfaff | F15B 11/055 60/424 |
| 8,453,793 | B1 | 6/2013 | Franzoi et al. | |
| 2013/0146162 | A1 | 6/2013 | Coolidge | |
| 2014/0069091 | A1 | 3/2014 | Franzoni et al. | |

* cited by examiner

*Primary Examiner* — Thomas E Lazo
(74) *Attorney, Agent, or Firm* — Quarles & Brady LLP

(57) ABSTRACT

A hydraulic control valve assembly to be integrated into a pressure compensated load sensing system including a fluid source is provided. The hydraulic control valve assembly includes a first working unit to control a first hydraulic function of a machine. The first working unit includes a first directional and return flow control in the form of a first spool, a first function flow control to selectively communicate a working pressure of the first function to the fluid source, and a first downstream flow control. The hydraulic control valve assembly further includes a second working unit arranged downstream of the first working unit. The second working unit to control a second hydraulic function of the machine. The first downstream flow control to selectively restrict a flow a fluid from the fluid source to the second working unit.

44 Claims, 8 Drawing Sheets

METERED FLUID SOURCE CONNECTION TO DOWNSTREAM FUNCTIONS IN PCLS SYSTEMS

RELATED APPLICATIONS

Not Applicable.

BACKGROUND

The present invention relates generally to hydraulic control systems and, more specifically, to systems and methods for improving multifunction performance in hydraulic control systems.

Hydraulic control systems on mobile machines (e.g., earth moving machines or material handling machines) can use a pressure compensated load-sensing (PCLS) system with one fluid source (e.g., a hydraulic pump) and one control valve. Together the fluid source and the control valve control several cylinders and/or motors, typically known as functions, to move the machine in an intended motion.

The rate at which the hydraulic functions on the machines operate depend upon the cross-sectional area of control orifices of the hydraulic system and the pressure drop across those control orifices. To facilitate control, PCLS systems are typically designed with a load sense pressure signal and compensators to maintain an approximately constant pressure drop across those control orifices. In this way, flow from the fluid source is shared among the functions according to the ratio of each function's control orifice cross-sectional area to the sum of all the control orifice cross-sectional areas. Often the greatest of the workport pressures is selected as the load sense pressure. The fluid source will increase or decrease the output flow to maintain an approximately constant differential pressure between the fluid source output pressure and the load sense pressure. As the number of or size of the control orifices is changed, the fluid source flow must be changed to maintain this differential pressure.

When the maximum flow capacity of the fluid source is reached due to increases in the number of or cross-sectional areas of the control orifices, the supply of fluid to any given function will be reduced compared to the supply of fluid that function would receive if the fluid source were able to maintain the pressure differential. However, when the maximum fluid source capacity is reached, in some applications, it is desirable to maintain as great a flow as possible to certain functions, even at the expense of a greater flow reduction to the other functions.

SUMMARY OF THE INVENTION

In one aspect, the present invention provides a hydraulic control valve assembly to be integrated into a pressure compensated load sensing hydraulic system including a fluid source having an outlet. The hydraulic control valve assembly includes a first working unit to control a first hydraulic function of a machine. The first working unit includes a first directional and return flow control in the form of a spool, a first function flow control to selectively communicate a working pressure of the first function to the fluid source, and a first downstream flow control. The hydraulic control valve assembly further includes a second working unit arranged downstream of the first working unit. The second working unit controls a second hydraulic function of the machine and includes a second directional and return flow control in the form of a second spool and a second function flow control to selectively communicate a working pressure of the second function to the fluid source. The hydraulic control valve assembly further includes a supply conduit extending through the first working unit and the second working unit and in fluid communication with the outlet of the fluid source. The fluid source responds to a change in at least one of the working pressure of the first function and the working pressure of the second function by varying a pressure at the outlet. The first downstream flow control to selectively restrict a flow of fluid from the fluid source to the second working unit.

In some embodiments, the hydraulic control valve assembly further comprises a third working unit arranged downstream of the second working unit, the third working unit to control a third hydraulic function of the machine and including a third directional and return flow control in the form of a third spool and a third function flow control to communicate a working pressure of the third function to the fluid source.

In some embodiments, the second working unit further comprises a second downstream flow control to selectively restrict a flow of fluid from the fluid source to the third working unit.

In some embodiments, the first downstream flow control is arranged to selectively restrict the flow of fluid in the supply conduit.

In some embodiments, the first downstream flow control is a variable orifice.

In some embodiments, the variable orifice is controlled as a function of the directional and return flow control.

In some embodiments, the variable orifice is controlled by a pilot pressure.

In some embodiments, the variable orifice is controlled by an electrical signal.

In some embodiments, the first downstream flow control is a fixed orifice.

In some embodiments, the first downstream flow control is arranged downstream of a first orifice of the first working unit.

In some embodiments, the hydraulic control valve assembly further comprises a secondary supply conduit extending from the supply conduit, the secondary supply conduit extending through the first working unit and the second working unit.

In some embodiments, the first downstream flow control is arranged to selectively restrict the flow of fluid in the secondary supply conduit.

In some embodiments, the first working unit further comprises a compensator and a secondary line providing a path for fluid to flow from the secondary supply conduit to a location downstream of the compensator.

In some embodiments, the secondary line includes a secondary line orifice.

In some embodiments, the secondary line orifice is a variable orifice controlled by a function of the direction and return flow control.

In another aspect, the present invention provides a hydraulic control valve assembly to be integrated into a pressure compensated load sensing hydraulic system including a fluid source having an outlet. The hydraulic control valve assembly includes a first working unit to control a first hydraulic function of a machine. The first working unit includes a first directional and return flow control in the form of a first spool and a first function flow control to control a flow of fluid to the first function and selectively communicate a working pressure of the first function to the fluid source. The hydraulic control valve assembly further includes a second working unit arranged downstream of the first working unit and to control a second hydraulic function of the machine. The second working unit includes a second directional and return flow control in the form of a second spool and a second function flow control to control a flow of fluid to the second function and selectively communicate a working pressure of the second function to the fluid source. The hydraulic control valve assembly further includes a supply conduit having a downstream flow control. The downstream flow control to selectively restrict a flow of fluid from the fluid source to at least one of the first working unit and the second working unit. The fluid source to respond to a change in at least one of the working pressure of the first function and the working pressure of the second function by varying a pressure at the outlet.

In some embodiments, the supply flow section is arranged downstream of the first working unit and upstream of the second working unit.

In some embodiments, the downstream flow control comprises a supply control valve and a flow limiting line, the flow limiting line providing a path for fluid to flow from a location upstream of the supply control valve to a location downstream of the supply control valve.

In some embodiments, the supply control valve is controlled by a pilot pressure.

In some embodiments, the supply control valve is controlled by an electrical signal.

In some embodiments, the flow limiting line includes a flow limiting line orifice arranged upstream of and in fluid communication with a supply compensator.

In some embodiments, the downstream flow control comprises a supply control valve arranged upstream of a compensator.

In some embodiments, the supply control valve is controlled by a pilot pressure.

In some embodiments, the supply control valve is controlled by an electrical signal.

In some embodiments, the supply flow section is arranged upstream of the first working unit.

In some embodiments, the hydraulic control valve assembly further comprises a secondary supply conduit extending from the supply conduit, the secondary supply conduit extending through the first working unit and the second working unit.

In some embodiments, the downstream flow control comprises a supply control valve to restrict fluid flow into the secondary supply conduit.

In some embodiments, the supply control valve is controlled by a pilot pressure.

In some embodiments, the supply control valve is controlled by an electrical signal.

In some embodiments, the first working unit further comprises a compensator and a secondary line providing a path for fluid to flow from the secondary supply conduit to a location downstream of the compensator.

In some embodiments, the secondary line includes a secondary line orifice.

In some embodiments, the secondary line orifice is a variable orifice controlled by a function of the direction and return flow control.

In yet another aspect, the present invention provides a hydraulic control valve assembly to be integrated into a pressure compensated load sensing hydraulic system including a fluid source having an outlet. The hydraulic control valve assembly includes a first working unit to control a first hydraulic function of a machine. The first working unit includes a first directional and return flow control in the form of a first spool, a first function fluid path to selectively communicate a working pressure of the first function to the fluid source, a first compensator, and a first variable downstream flow control orifice. The first spool includes a first variable spool orifice. The hydraulic control valve assembly further includes a second working unit arranged downstream of the first working unit. The second working unit controls a second hydraulic function of the machine and includes a second directional and return flow control in the form of a second spool, a second function fluid path to selectively communicate a working pressure of the second function to the fluid source, and a second compensator. The second spool includes a second variable spool orifice. The hydraulic control valve assembly further includes a supply conduit extending through the first working unit and the second working unit and in fluid communication with the outlet of the fluid source. The fluid source to respond to a change in at least one of the working pressure of the first function and the working pressure of the second function by varying a pressure at the outlet. The first variable downstream flow control orifice is arranged in series with and upstream of the second variable spool orifice and selectively restricts a flow of fluid from the fluid source to the second working unit.

In some embodiments, the first variable downstream flow control orifice is controlled by a position of the first spool.

In some embodiments, the first variable downstream flow control orifice is controlled by a pilot pressure.

In some embodiments, the first variable downstream flow control orifice is controlled by an electrical signal.

In some embodiments, the hydraulic control valve assembly further comprises a first compensator bypass line providing a path for fluid to flow from a location upstream of the first compensator to a location downstream of the first compensator.

In some embodiments, the first compensator bypass line include a first bypass orifice.

In some embodiments, the first bypass orifice is a variable orifice.

In some embodiments, the first bypass orifice is controlled by a position of the first spool.

In some embodiments, the hydraulic control valve assembly further comprises a second compensator bypass line providing a path for fluid to flow from a location upstream of the second compensator to a location downstream of the second compensator.

In some embodiments, the second compensator bypass line include a second bypass orifice.

In some embodiments, the second bypass orifice is a variable orifice.

In some embodiments, the second bypass orifice is controlled by a position of the second spool.

The foregoing and other aspects and advantages of the invention will appear from the following description. In the description, reference is made to the accompanying drawings which form a part hereof, and in which there is shown by way of illustration a preferred embodiment of the invention. Such embodiment does not necessarily represent the full scope of the invention, however, and reference is made therefore to the claims and herein for interpreting the scope of the invention

DESCRIPTION OF DRAWINGS

The invention will be better understood and features, aspects and advantages other than those set forth above will become apparent when consideration is given to the following detailed description thereof. Such detailed description makes reference to the following drawings

DETAILED DESCRIPTION OF THE INVENTION

The use of the terms "downstream" and "upstream" herein are terms that indicate direction relative to the flow of a fluid. The term "downstream" corresponds to the direction of fluid flow, while the term "upstream" refers to the direction opposite or against the direction of fluid flow.

One non-limiting example of particular importance in track-type mobile machines is commanding the tracks with other functions under various load conditions. In this non-limiting example, other functions commanded at the same time as the track are still required to operate; however, the tracks should be given priority and required to maintain at least a minimum speed (e.g., track speed should not fall below 50% of tracks-only operation). In a fully compensated system, if the total commanded flow exceeds 200% of the pump available flow, the reduction in track flow will become unacceptable. In a non-fully compensated system, the flow to each function does not reduce proportionally. If the other (non-track) functions are undercompensated and operating at a lower pressure than the tracks, then the flow to the track functions are reduced further than in a fully compensated system resulting in unacceptable track speed.

Another non-limiting example of particular importance in mobile machines is boom operation with slew (i.e., rotation). Typically, for a given slew motion (e.g., slewing from rest to 90 degrees), the boom must raise above a certain height where generally a higher boom height is desirable. At the start of the operation, the boom and slew functions are fully commanded simultaneously. Initially, high slew inertia causes the slew function to command maximum system pressure which results in maximum torque applied to the slew function. The resulting high slew acceleration causes the slew function to move faster in relation to the boom function than desired to achieve acceptable boom height requirements. Under compensating the boom function results in a lower system pressure which leads to a lower slew acceleration rate. After the slew reaches a steady state velocity, the torque load on the slew function reduces causing it to operate at a lower pressure than the boom. The slew function compensator becomes active and restricts flow to the slew allowing slew and boom to proportionally share the available pump flow. By properly under compensating the boom, an acceptable boom height is achieved. Due to the current deficiencies in pressure compensated load sensing (PCLS) hydraulic systems it would be desirable to have a hydraulic system that improves multifunction performance by restricting the flow commanded of a function when an upstream function is commanded and that creates priority by directly reducing the flow commanded by downstream functions.

Figure 1:
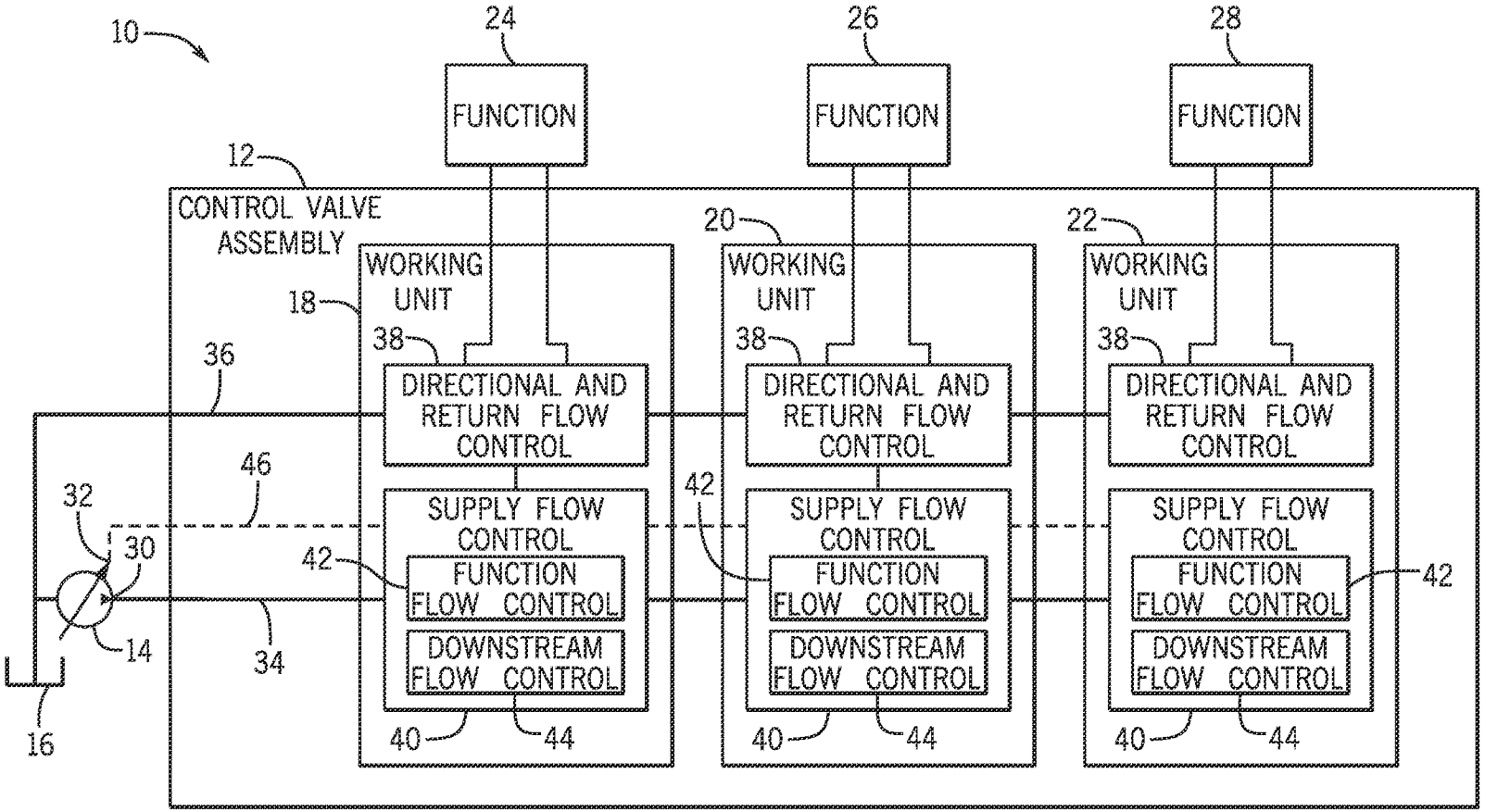
FIG. 1 shows a schematic illustration of a pressure compensated load sensing (PCLS) hydraulic system including a control valve assembly having a downstream flow control integrated into each working unit in accordance with one embodiment of the present invention.

FIG. 1 shows a PCLS hydraulic system 10 for controlling one or more functions of a mobile machine, such as an excavator, in accordance with one embodiment of the present invention. The PCLS hydraulic system 10 includes a control valve assembly 12, a fluid source 14, and a reservoir 16. The control valve assembly 12 includes one or more working units 18, 20, and 22. As shown in FIG. 1, the illustrated control valve assembly 12 includes three working units 18, 20, and 22, with the working unit 20 arranged downstream of the working unit 18, and the working unit 22 arranged downstream of the working unit 20. The number of working units is not meant to be limiting in any way and it should be appreciated that the control valve assembly 12 can include any number of working units as required by the mobile machine. It should also be known that the working units 18, 20, and 22 could be arranged between an inlet unit (not shown) and an outlet unit (not shown). The control valve assembly 12 may have a single monolithic body or comprise physically separate valve sections attached side by side.

Each of the working units 18, 20, and 22 can be in fluid communication with a corresponding function 24, 26, and 28, as shown in FIG. 1. As will be described in detail below, each of the working units 18, 20, and 22 can control the operation of the corresponding function 24, 26, and 28 by controlling when fluid communication is provided between the fluid source 14 and the corresponding function 24, 26, and 28 and by controlling the flow of fluid from the fluid source 14 to the corresponding function 24, 26, and 28.

The fluid source 14 can be a variable displacement pump which draws fluid, such as oil, from the reservoir 16 and furnishes that fluid under increased pressure at an outlet 30. The pressure of the fluid provided by the fluid source 14 at the outlet 30 can be responsive to a pressure signal at a load sense port 32. The fluid source 14 can be configured to maintain the pressure at the outlet 30 to be a constant differential, known as rated margin pressure, greater than the pressure at the load sense port 32 (i.e., pressure compensated load sensing). The fluid source 14 can increase or decrease its displacement in order to maintain the rated_margin pressure between the outlet 30 and the load sense port 32.

In other embodiments, the fluid source 14 can be a fixed displacement pump that may be used in combination with a pump compensator configured to divert excess flow back to the reservoir 16 in order to maintain a constant pressure differential. It is to be appreciated that other sources of pressurized fluid are also possible to supply fluid to the pressure compensated load sensing hydraulic system 10.

The outlet 30 can be in fluid communication with a supply conduit 34. The supply conduit 34 can extend through the inlet unit (not shown), each of the working units 18, 20 and 22, and can terminate at or in the outlet unit (not shown), or can extend from the outlet unit (not shown), to another function. A return conduit 36 can provide fluid communication between each of the working units 18, 20 and 22 and the reservoir 16.

As shown in FIG. 1, the working units 18, 20, and 22 can include similar features which are identified with like reference numerals. The following description of the working units 18 also applies to the working units 20, and the working unit 22. The working unit 18 can include directional and return flow control 38 and supply flow control 40. The directional and return flow control 38 can be in fluid communication with the supply flow control 40 and the function 24. The directional and return flow control 38 can be configured to selectively control, based on the desired operation of the function 24, when fluid communication is provided between the function 24 and both the supply conduit 34 and the reservoir 16. In some embodiments, the directional and return flow control 38 can be a spool that may be manually actuated, hydraulically actuated, or electrohydraulically actuated.

The supply flow control 40 can include function flow control 42 and downstream flow control 44. The supply flow control 40 is in fluid communication with the supply conduit 34, a load sense conduit 46, and the directional and return flow control 38. The function flow control 42 can be configured to control the flow of fluid from the supply conduit 34 to the function 24, when fluid communication is enabled between the supply conduit 34 and the function 24 by the directional and return flow control 38. In some embodiments, the function flow control 42 can include a compensator configured to maintain a desired pressure upstream of the compensator to be substantially equal to the pressure at the load sense port 32. Additionally, the function flow control 42 can be configured to communicate a working pressure (or load) of the function 24 to the load sense conduit 46. In this way, the function flow control 32 of each of the working units 18, 20, and 22 can cooperate to ensure the pressure being communicated to the load sense conduit 46, and therefore to the load sense port 32, is that of the highest load function. In other embodiments, the function flow control 42 can include a path for fluid to flow through a flow control device other than a compensator. For example, a variable orifice metered on the spool.

It is to be appreciated that some components of the directional and return flow control 38 (i.e., the spool) may be included in the supply flow control 40. That is, the spool can include one or more flow restricting features (i.e., orifices) that can control or influence the flow of fluid from the supply conduit 34 to the respective function 24, 26, and 28. Thus, in some embodiments, the spool can control when fluid communication is provided between the function 24 and the supply conduit 34 and the reservoir 16, and control the flow of fluid from the supply conduit 34 to the function 24. Alternatively or additionally, some components of the supply flow control 40 may be a function of or controlled by a position of directional and return flow control 38 (i.e., the spool). That is, in some embodiments, the downstream flow control 44 can be incorporated onto the directional and return flow control 38 (i.e., the spool).

In one embodiment, the downstream flow control 44 of each of the working units 18, 20, and 22 can be a variable orifice that can be a function of the position of the directional and return flow control 38 (i.e., the spool). In another embodiment, the downstream flow control 44 of each of the working units 18, 20, and 22 can be a variable orifice that can be controlled by pilot pressure (e.g., track pilot command) or controlled electronically by a controller (not shown) of the PCLS hydraulic system 10. In still another embodiment, the downstream flow control 44 of each of the working units 18, 20, and can be a fixed orifice that provides continuous limiting, or restriction, of the downstream fluid flow. In yet another embodiment, the downstream flow control 44 of each of the working units 18, 20, and 22 can be a pressure reducer configured to limit a maximum pressure being supplied in the supply conduit 34 to downstream functions. In any case, the downstream flow control 44 can be provided in series with a downstream working unit. That is, the downstream flow control 44 of the working unit 18 is in series with the working unit 20, and so on.

During multifunction operation, the downstream flow control 44 can be configured to limit the flow of fluid in the supply conduit 34 being supplied to downstream functions, as will be described in detail below. Typically, as described above, PCLS systems are designed such that the fluid source 14 attempts to maintain the rated margin pressure between the outlet 30 and the load sense port 32. A theoretical flow command when a single function (either function 24, 26, or 28) is commanded can be an expected fluid flow to that function for a given flow area (e.g., a cross-sectional area of orifice(s) on the spool) between the outlet 30 and through the respective working unit (either working unit 18, 20, or 22) when the fluid source 14 is able to maintain the rated margin pressure. As the directional and return flow control 38 (i.e., the spool) is moved based on a desired operation of a given function, the theoretical flow commanded of that function is proportional to the change in the flow area.

In the non-limiting example of a fully compensated system (i.e., the fluid must flow from the outlet 30 through a compensator in the supply flow control 40 to reach a given function), when multiple functions are commanded (e.g., when functions 24, 26, and 28 are all commanded), the fluid supplied by fluid source 14 must flow share amongst the commanded functions 24, 26, and 28. A portion of the total fluid flow provided at the outlet 30 received by each commanded function 24, 26, and 28 can be governed by a flow area ratio of a cross-sectional area of a control orifice in a given working unit supplying fluid flow to a commanded function to a summation of the cross-sectional areas of the control orifices in all the working units supplying fluid flow to the commanded functions.

The downstream flow control 44 of each of the working units 18, 20, and 22 can alter the flow sharing characteristics during multifunction operation by altering the flow area ratio. That is, the addition of the downstream flow control 44 to the PCLS system 10 can provide a restriction, in addition to the control orifices, that can limit the amount of the total fluid flow provided to downstream functions. For example, with reference to FIG. 1, the downstream flow control 44 of the working unit 18 can be used to limit or restrict the flow to the function 26 and the function 28. With the downstream flow control 44 providing an additional restriction, function 24 is provided with a greater portion of the total fluid flow and functions 26 and 28 are forced to share the flow downstream of working unit 18. The flow downstream of working unit 18 is shared between functions 26 and 28 according to the area ratio between working units 20 and 22 (i.e., the area ratio of the control orifices in working units 20 and 22). The remaining portion of the total fluid flow, downstream of working unit 18, can be reduced (i.e., the effective flow commands of functions 26 and 28 are less than the theoretical flow commands) when compared with operation without the additional restriction provided by the downstream flow control 44 of working unit 18. In this way, the downstream flow control 44 of working unit 18 can force downstream functions 26 and 28 to operate under an effective margin pressure which is less than the rated margin pressure thereby providing a greater portion of the available flow (i.e., priority) to functions upstream of the downstream flow control 44 relative to functions downstream of the downstream flow control 44. The downstream flow control 44 of each of the working units 20 and 22 can be used to restrict or limit the flow to downstream functions in a similar fashion, as described above, with respect to the downstream flow control 44 of working unit 18.

Figure 2:
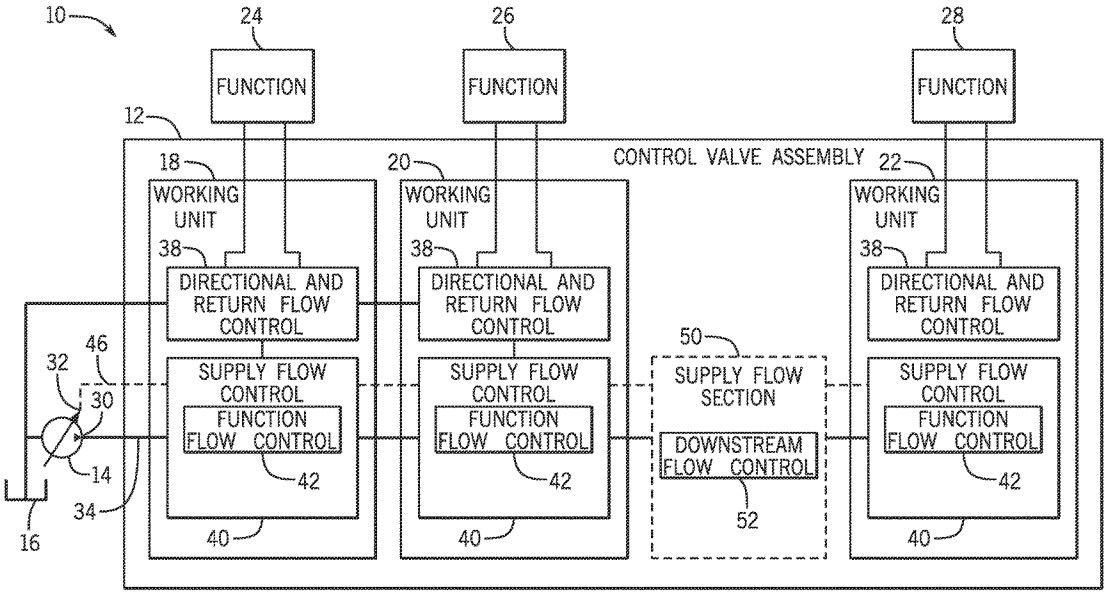
FIG. 2 shows a schematic illustration of the PCLS hydraulic system of FIG. 1 where the downstream flow control is integrated into a supply flow section arranged between two working units in accordance with another embodiment of the present invention.

FIGS. 2-5 show alternative embodiments of the PCLS hydraulic system 10 with downstream flow control integrated into different locations. It should be known that although the downstream flow control may be shown in a different location within the PCLS hydraulic system 10 when compared to the downstream flow control 44 of FIG. 1, the operation of limiting or restriction the flow to downstream functions can be accomplished in a similar manner as described above with respect to FIG. 1. As shown in FIG. 2, the control valve 12 can include a supply flow section 50 which can be arranged between the working unit 20 and the working unit 22. It should be known that, in other embodiments, the supply flow section 50 may be arranged between the working unit 18 and the working unit 20, or between any working units if the control valve 12 includes additional working units. In the embodiment of FIG. 2, the supply flow section 50 includes downstream flow control 52 which can be configured to limit or restrict the flow of fluid in the supply conduit 34 supplied to downstream functions (i.e., the function 28), as will be described in detail below.

Figure 3:
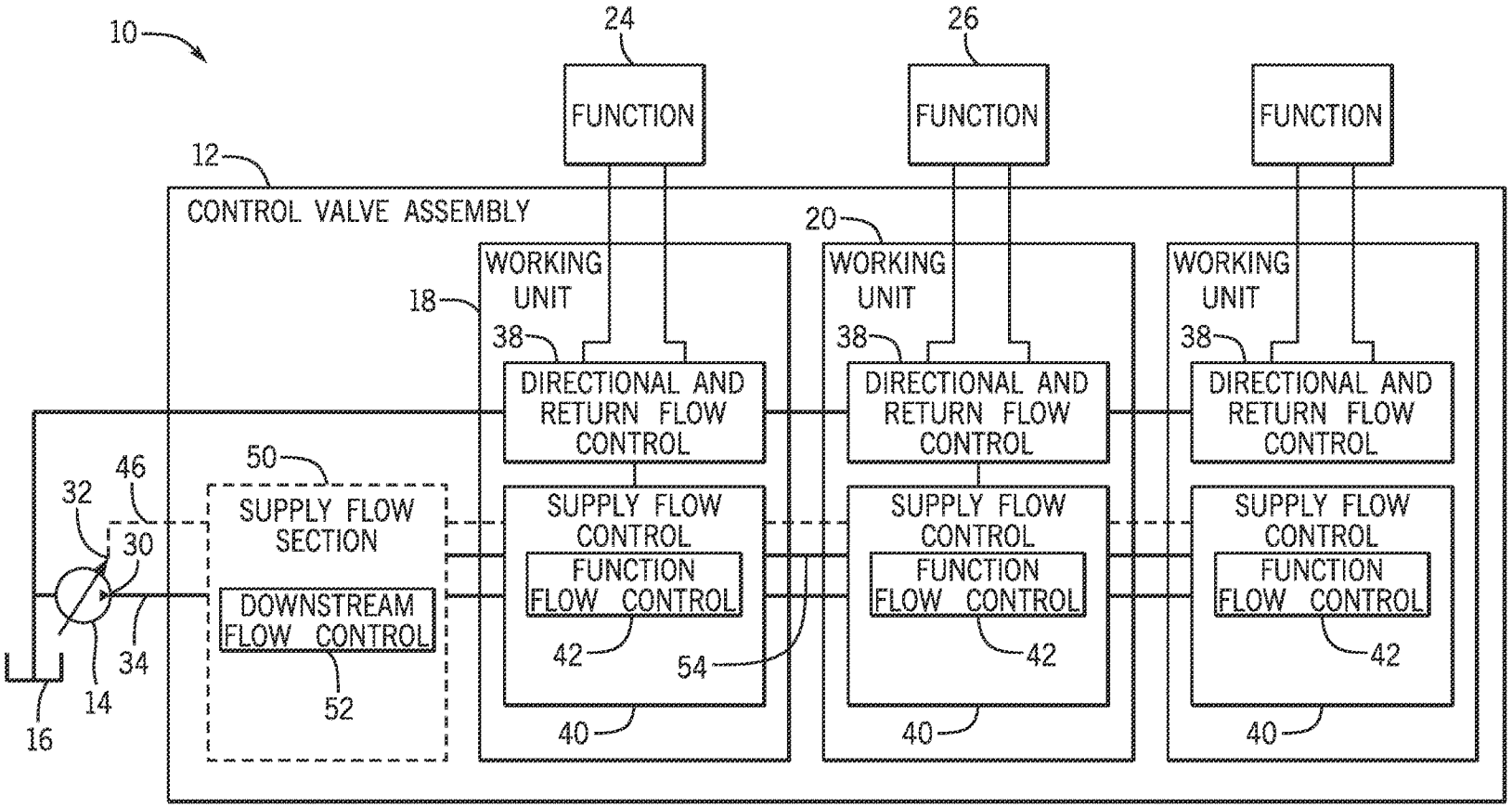
FIG. 3 shows a schematic illustration of the PCLS hydraulic system of FIG. 1 where the downstream flow control is integrated into a supply flow section arranged upstream of the working units in accordance with yet another embodiment of the present invention.

FIG. 3 shows another embodiment of the PCLS hydraulic system 10 in accordance with the present invention. In the embodiment of FIG. 3, the supply flow section 50 can be arranged upstream of the working units 18, 20, and 22 and can include the downstream flow control 52. Also, a secondary supply conduit 54 can originate in the supply flow section 50 and can extend through each of the working units 18, 20 and 22, and can terminate at or in the outlet unit (not shown), or can extend from the outlet unit (not shown), to another function. In the embodiment of FIG. 3, the downstream flow control 52 can selectively provide or inhibit fluid to flow into the secondary supply conduit 54 to limit or restrict the flow of fluid to downstream function, as will be described in detail below.

As shown in FIG. 3, in this embodiment each of the working units 18, 20, and 22 may not include the downstream flow control 44, as the limiting or restricting of the flow of fluid to downstream functions may be provided by the supply flow section 50. However, in another embodiment shown in FIG. 4, the supply flow section 50 may not include the downstream flow control 52 and the working units 18, 20, and 22 may each include the downstream flow control 44 which can limit or restrict the flow of fluid to downstream functions.

Figure 4:
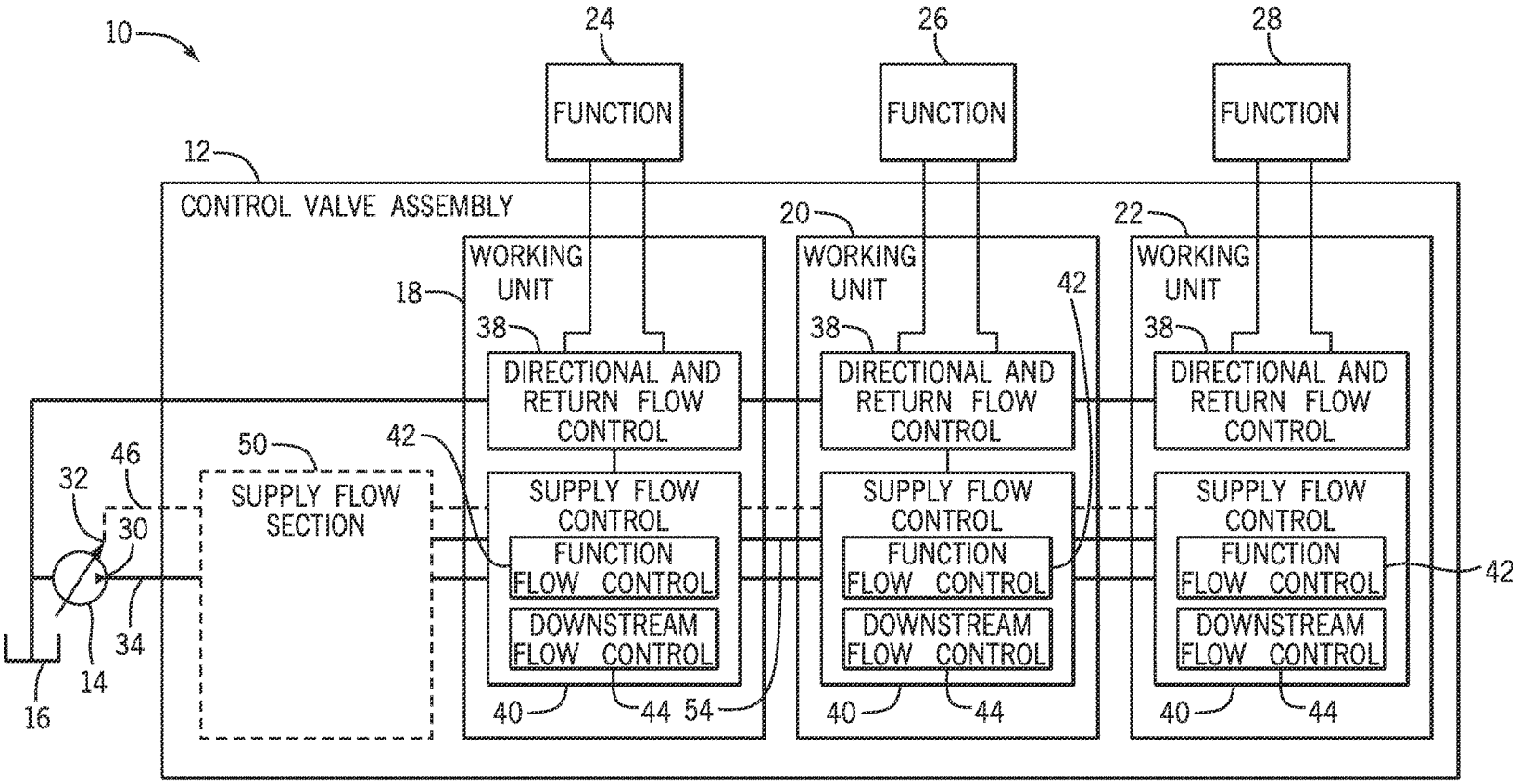
FIG. 4 shows a schematic illustration of the PCLS hydraulic system of FIG. 1 where the downstream flow control is integrated into each working unit and a supply flow section is arranged upstream of the working units in accordance with another embodiment of the present invention.
Figure 5:
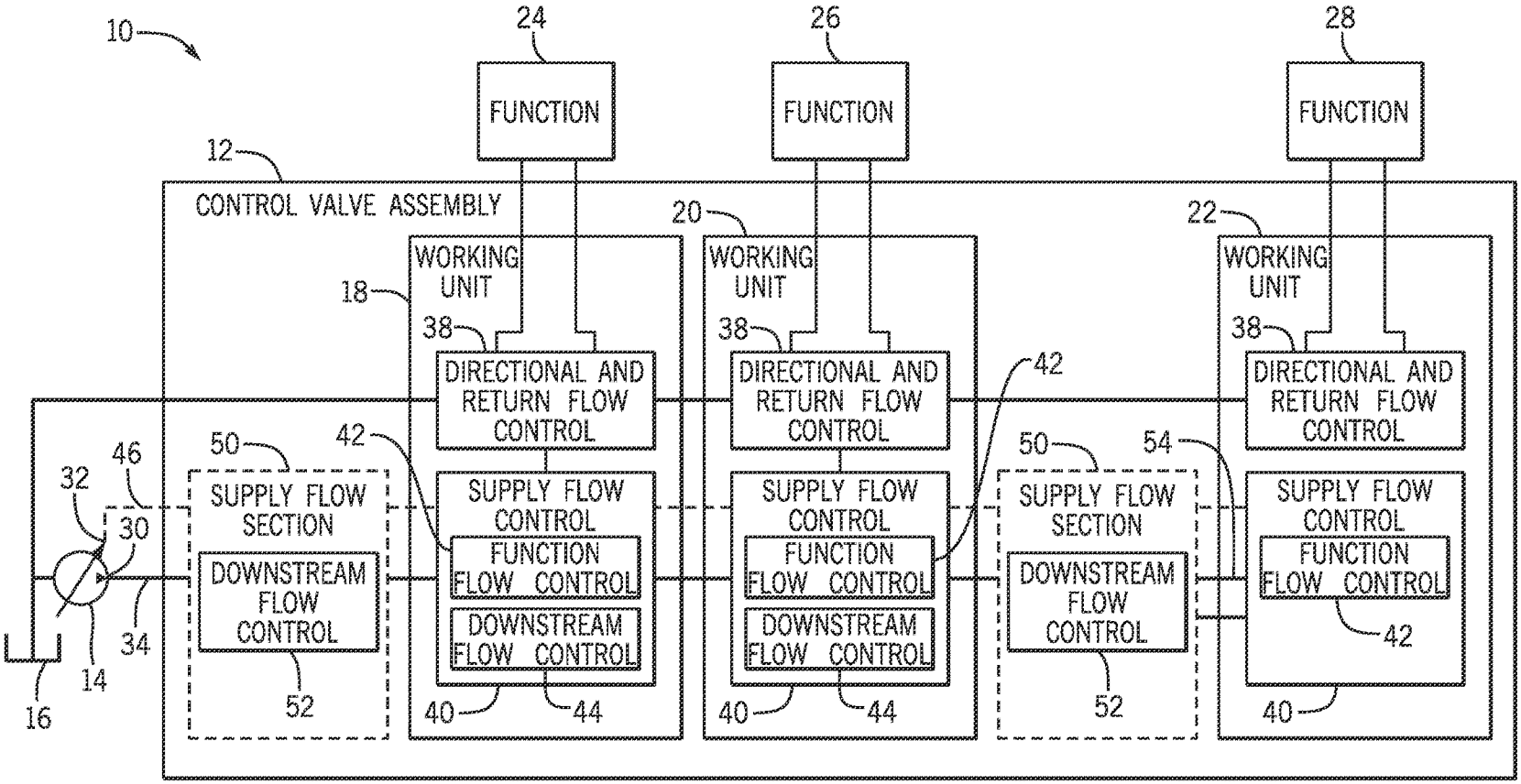
FIG. 5 shows a schematic illustration of the PCLS hydraulic system of FIG. 1 combining various features shown in FIGS. 1-4 in accordance with yet another embodiment of the present invention.

One or ordinary skill in the art would recognize that the various techniques described above with respect to FIGS. 1-4 to limit or restrict the flow of fluid to downstream functions may be combined, as shown in FIG. 5, to achieve a similar result. It should be appreciated that alternative combinations of the techniques illustrated in FIGS. 1-4 are possible to achieve limited or restricted fluid flow to downstream functions and are within the scope of the present invention.

Figure 6A:
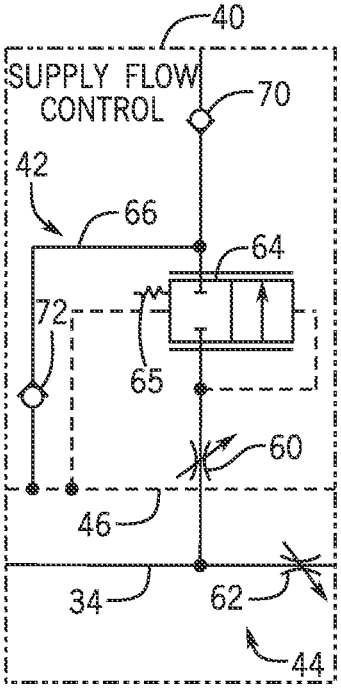
FIG. 6A shows a schematic illustration of a supply flow control to be integrated into the PCLS hydraulic system of FIG. 1 in accordance with one embodiment of the present invention.

FIG. 6A shows one embodiment of the supply flow control 40 that can be integrated into the embodiment of the PCLS hydraulic system 10 shown in FIG. 1. As shown in FIG. 6, supply flow control 40 can include a first orifice 60 and a second orifice 62. The first orifice 60 can provide fluid communication between the supply conduit 34 and a compensator 64. The first orifice 60 may be a control, or a main metering, orifice of the directional and return flow control 38 (i.e., the spool). In some embodiments, the first orifice 60 and/or the second orifice 62 can be a variable orifice that can be controlled by a function of the directional and return flow control 38 (i.e., the spool) position. That is, the opening of, or pressure drop across, the variable orifice can be a function of the spool position. In other embodiments, the first orifice 60 and/or the second orifice 62 can be a variable orifice controlled by pilot pressure (e.g., track pilot command) or controlled electronically by a controller (not shown) of the PCLS hydraulic system 10. In still other embodiments, the first orifice 60 and/or the second orifice 62 can be a fixed orifice that provides continuous limiting, or restriction, of the downstream fluid flow. The second orifice 62 can be configured to limit or restrict fluid flow to downstream functions (i.e., the second orifice 62 of the working unit 18 can limit or restrict fluid flow to functions 26 and 28, and so on). This can be achieved by the second orifice 62 being arranged upstream from and in series with the first orifice 60 of downstream working units (i.e., the second orifice 62 of the working unit 18 can be arranged upstream from and in series with the first orifice 60 of the working unit 20, and so on).

The supply flow control 40 can include a compensator 64 which can be biased into a normally closed position. In some embodiments, the compensator 64 can be biased into the normally closed position by a spring 65 and/or a pressure from a load sense conduit 46. Once a pressure downstream of the first orifice 60 and upstream of the compensator 64 is greater than the pressure provided by the spring 65 and the load sense conduit 46, the compensator 64 can be biased into an open position, as shown in FIG. 6A. This operation of the compensator 64 maintains a desired pressure downstream of the first orifice 60 to be substantially equal to the pressure at the load sense port 32. The fluid source 14 can attempt to maintain a desired pressure upstream of the first orifice 60 to be substantially equal to the pressure at the load sense port 32 plus the rated margin pressure, so in combination with the fluid source 14, the first orifice 60 can have pressure drop substantially equal to the rated margin pressure.

The supply flow control 40 can include a load sense line 66 and a supply check valve 70. The load sense line 66 can communicate the pressure at a location downstream of the compensator 64 to the load sense conduit 46 through a load sense check valve 72. The load sense conduit 46 then communicates the pressure at the location downstream of the compensator 64 to the load sense port 32 of the fluid source 14. The pressure at the location downstream of the compensator 64 can be the pressure at a workport of the directional and return flow control 38 (i.e., the spool). The load sense check valve 72 can inhibit fluid flow in the load sense line 66 from the load sense conduit 46 to the location downstream of the compensator 64.

The supply check valve 70 is arranged downstream of the compensator 64 and upstream of the respective function controlled by the working unit. The supply check valve 70 can inhibit fluid flow from the function to the compensator 64.

With continued reference to FIG. 6A, the load sense lines 66 of each of the working units 18, 20 and 22 can communicate the pressure downstream of the compensator 64 to the load sense conduit 46. This communicates the operating pressure, or load, of the functions 24, 26, and 28 to the load sense port 32 via the load sense conduit 46. Thus, the fluid source 14 can increase or decrease its displacement to maintain the rated margin pressure in response to changes in the highest load of any of the functions 24, 26, and 28. The load check valve 72 of each of the working units 18, 20, and 22 can result in the pressure in the load sense conduit 46 being connected to the highest load function.

During operation of the embodiment of the PCLS hydraulic system 10 of FIG. 1 with the supply flow control 40 of FIG. 6A integrated into the PCLS hydraulic system 10, fluid can be output by the fluid source 14 into the supply conduit 34 which then can be commanded by one or more of the functions 24, 26, and 28 by actuating the corresponding directional and return flow control 38 (i.e., the spool). In one non-limiting example, all the functions 24, 26 and 28 can be commanded simultaneously during the operation of the mobile machine with the function 24 operating at a higher pressure than the function 26 and the function 28 (only one function will be the highest load function). Once the functions 24, 26 and 28 are commanded, the compensator 64 of the working unit 18 (the working unit connected to the highest load function) will open, and compensator 64 of the working unit 20 and compensator 64 of the working unit 22 will close proportionally restricting the fluid flow to the function 26 and the function 28 until a pressure substantially equal to the pressure in the load sense conduit 46 is achieved downstream of the first orifice 60. The second orifice 62 of the working unit 18 can be used to further (in addition to the compensators 64 of the downstream working units 20 and 22) restrict the flow to downstream functions (i.e., the functions 26 and 28) by reducing the amount of fluid flow available downstream of the second orifice 62. In this way, the further restriction provided by the second orifice 62 of working unit 18 can cause the functions 26 and 28 to operate under an effective margin pressure that is reduced when compared to the rated margin pressure. The reduced effective margin pressure provides a lower effective flow command for functions 26 and 28 when compared to the theoretical flow command (i.e., single function operation) which enables function 24 to consume a greater portion of the available fluid flow (i.e., function 24 is given priority). The second orifice 62 of each of the working units 20 and 22 can be used to restrict or limit the flow to downstream functions in a similar fashioned, as described above, with respect to the second orifice 62 of working unit 18.

Although the operation of the PCLS hydraulic system 10 was described above with reference to the simultaneous commanding of the functions 24, 26, and 28, it should be known that restricting or limiting downstream functions via the second orifice 62 of any of the working units 18, 20, and 22 can be applied to other hydraulic systems with any number of functions and corresponding control valve units. Additionally, since the second orifice 62 of each of the working units 18, 20, and 22 can be a variable, it can be used to selectively provide priority to any upstream functions by restricting or limiting any downstream functions, as desired. In the embodiment where the second orifice 62 of each of the working units 18, 20, and 22 are on the spool, the second orifices 62 of any of the working units 18, 20, and 22 can provide a different restriction for different directions of movement. For example, boom up versus boom down can have different priority requirements relative to swing.

Figure 6B:
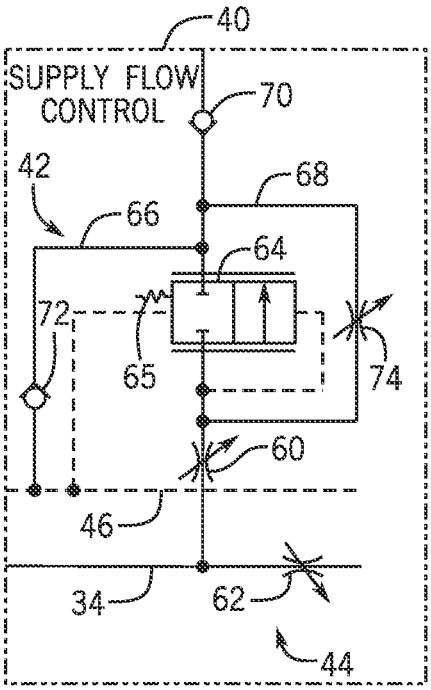
FIG. 6B shows a schematic illustration of a supply flow control to be integrated into the PCLS hydraulic system of FIG. 1 in accordance with another embodiment of the present invention.

FIG. 6B shows another embodiment of the supply flow control section of FIG. 6A with the addition of a compensator bypass line 68. The compensator bypass line 68 can provide a path for fluid to bypass the compensator 64 and flow through a bypass orifice 74. Specifically, the compensator bypass line 68 can provide a path for fluid to flow from a location between the first orifice 60 and the compensator 64 to a location downstream of the compensator 64. The bypass orifice 74 can be a variable orifice that can be metered on the directional and return flow control 38 (i.e., the spool). In other embodiments, the bypass orifice 74 can be a variable orifice controlled by pilot pressure or controlled electronically by a controller (not shown) of the PCLS hydraulic system 10. In still other embodiments, the bypass orifice 74 can be a fixed orifice that provides continuous limiting, or restriction, of the fluid flow to the respective function. The bypass passage 68 can be used when full compensation is not desired for certain multifunction situations.

Figure 7:
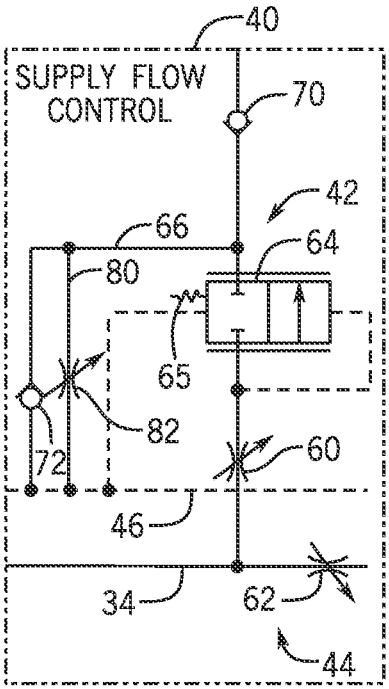
FIG. 7 shows a schematic illustration of a supply flow control to be integrated into the PCLS hydraulic system of FIG. 1 in accordance with yet another embodiment of the present invention.

FIG. 7 shows another embodiment of the supply flow control 40 that can be integrated into the embodiment of the PCLS hydraulic system 10 shown in FIG. 1. As shown in FIG. 7, the embodiment of FIG. 7 can include similar features to the embodiment of FIG. 6, with similar features being identified with like reference numerals. The differences between the embodiment of FIG. 6B and the embodiment of FIG. 7 will be described below.

As shown in FIG. 7, the supply flow control 40 may not include the bypass line 68 and the bypass orifice 74, and can include a secondary load sense line 80 which can tee off from the load sense line 66 at a location upstream of the load sense check valve 72. The secondary load sense line 80 can provide fluid communication from the location upstream of the load sense line check valve 72 to the load sense conduit 46, and can include a load sense orifice 82. The load sense orifice 82 can be a variable orifice that can be metered on the directional and return flow control 38 (i.e., the spool). In other embodiments, the load sense orifice 82 can be a variable orifice controlled by pilot pressure or controlled electronically by a controller (not shown) of the PCLS hydraulic system 10. In still other embodiments, the bypass orifice 82 can be a fixed orifice that provides continuous limiting, or restriction, of the downstream fluid flow.

The operation of the embodiment of the PCLS hydraulic system 10 of FIG. 1 with the supply flow control 40 of FIG. 7 integrated into the PCLS hydraulic system 10 is similar to the operation of the embodiment of the PCLS hydraulic system 10 of FIG. 1 with the supply flow control 40 of FIG. 6B integrated into the PCLS hydraulic system 10, described above. In particular, the limiting or restricting of fluid flow to downstream functions via the second orifice 62 of any of the working units 18, 20, and 22 remains similar. Alternatively or additionally, the load sense orifice 82 of any of the working units 18, 20, and 22 may be used to restrict or reduce a pressure in the load sense conduit 46 thereby selectively reducing the available pump flow to certain functions and giving priority to other functions depending on the operating pressure of each function.

Figure 8A:
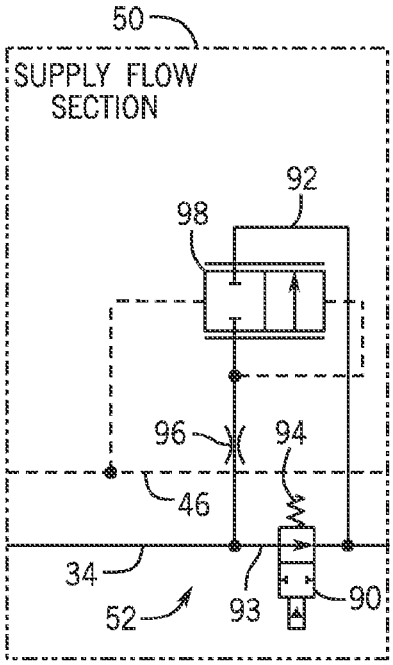
FIG. 8A shows a schematic illustration of a supply flow section to be integrated into the PCLS hydraulic system of FIG. 2 in accordance with one embodiment of the present invention.

FIG. 8A shows one embodiment of the supply flow section 50 that can be integrated into the embodiment of the PCLS hydraulic system 10 shown in FIG. 2. As shown in FIG. 8A, the supply flow section 50 can include a supply control valve 90, a flow limiting line 92, and a flow limiting bypass line 93. The supply control valve 90 can be biased into a normally open position. In some embodiments, the supply control valve 90 can be biased into the normally open position by a spring 94. A pilot signal (e.g. a track pilot line of a track-type mobile machine) pressure greater than the pressure provided by the spring 94 can be used to bias the supply control valve 90 into a closed position where flow can be forced through the flow limiting line 92. In other embodiments, the supply control valve 90 can be electronically controlled and selectively biased into the closed position by a controller (not shown) of the PCLS hydraulic system 10. The flow limiting line 92 can provide a flow path from a location upstream of the supply control valve 90 to a location downstream of the supply control valve 90. The flow limiting line 92 can include a flow limiting line orifice 96 arranged upstream from a supply compensator 98. The flow limiting line orifice 96 can be a fixed orifice or, in other embodiments, the flow limiting line orifice 96 can be a variable orifice controlled by pilot pressure or controlled electronically by a controller (not shown) of the PCLS hydraulic system 10.

Figure 8B:
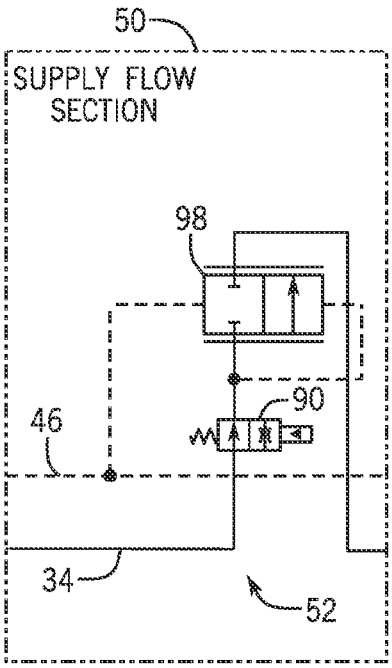
FIG. 8B shows a schematic illustration of a supply flow section to be integrated into the PCLS hydraulic system of FIG. 2 in accordance with another embodiment of the present invention.

The supply compensator 98 in combination with orifice 96 can restrict or limit the flow to downstream functions (i.e., the function 28), when fluid flows through the flow limiting line 92. The supply compensator 98 in combination with the flow limiting line orifice 96 can determine a maximum flow allowed downstream of the supply flow section 50. The supply compensator 98 can maintain the pressure downstream of the flow limiting line orifice 96 to be substantially equal to the pressure in the load sense conduit 46. The fluid source 14 can maintain a desired pressure upstream of the flow limiting line orifice 96 to be substantially equal to the pressure at the load sense port 32 plus the margin pressure, so in combination with the fluid source 14, the flow limiting line orifice 96 can have a pressure drop substantially equal to the margin pressure. In some embodiments, the flow limiting line orifice 96 can instead be an orifice arranged in the working units upstream of the supply flow section 50 (e.g., the working units 18 and 20) or the flow limiting line orifice 96 could be a fixed orifice. In another embodiment, the supply compensator 98 could also be located downstream of a normally open supply control valve 90. In this embodiment, the flow limiting bypass line 93 can be eliminated, as shown in FIG. 8B. In another embodiment of FIG. 8B, the normally open supply control valve 90 may be replaced by a variable orifice controlled by pilot pressure or controlled electronically by a controller (not shown) of the PCLS hydraulic system 10.

During operation of the embodiment of the PCLS hydraulic system 10 of FIG. 2 with the supply flow section 50 of FIG. 8A integrated into the PCLS hydraulic system 10, fluid is output by the fluid source 14 into the supply conduit 34 which then can be commanded by one or more of the functions 24, 26, and 28 by actuating the corresponding directional and return flow control (i.e., the spool). In one non-limiting example, the functions 24, 26 and 28 can be commanded simultaneously during the operation of the mobile machine. When either the function 24 or the function 26 are commanded, supply control valve 90 can be biased into a closed position where flow can be forced through the flow limiting line 92. In response, the supply compensator 98 in combination with the flow limiting line orifice 96 can determine a maximum flow allowed downstream of the supply flow section 50 (i.e., to the function 28).

Although the operation of the PCLS hydraulic system 10 was described above with reference to the simultaneous commanding of the functions 24, 26, and 28, it should be known that limiting downstream functions via the supply flow section 50 can be applied to other hydraulic systems with any number of functions and corresponding control valve units. In particular, the supply flow section 50 can be incorporated into other embodiments of the invention described herein.

Figure 9:
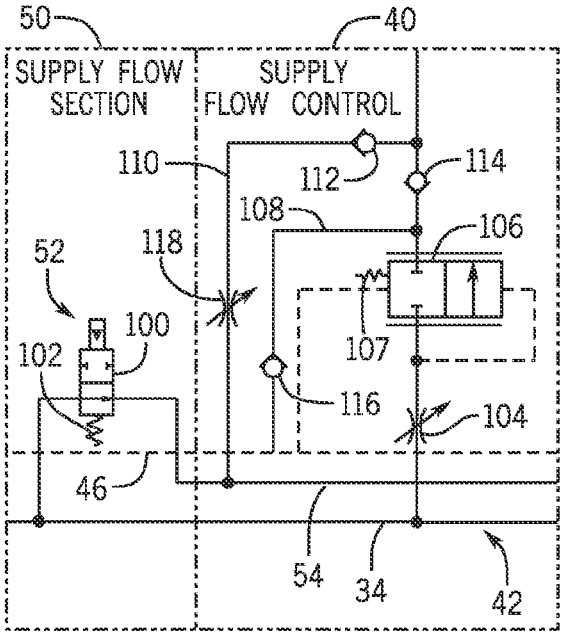
FIG. 9 shows a schematic illustration of a supply flow section and a supply flow control to be integrated into the PCLS hydraulic system of FIG. 3 in accordance with one embodiment of the present invention.

FIG. 9 shows another embodiment of the supply flow control 40 and the supply flow section 50 that can be integrated into the embodiment of the PCLS hydraulic system 10 shown in FIG. 3. As shown in FIG. 9, the secondary supply conduit 54 tees off from the supply conduit 34 within the supply flow section 50. The supply flow section 50 can include a supply valve 100 which can restrict fluid flow into the secondary supply conduit 54 when a given function or functions (i.e., one or more of the functions 24, 26, and 28) are commanded. That is, a pilot pressure of one or more of the functions 24, 26, and 28 can be in fluid communication with the supply valve 100 such that when the given functions are commanded, the force of spring 102 is overcome and the supply valve 100 moves to a closed position where fluid flow is restricted into the secondary supply conduit 54.

The supply flow control 40 can include a first orifice 104 which can provide fluid communication between the supply conduit 34 and a compensator 106. In some embodiments, the first orifice 104 can be a variable orifice that is a function of the directional and return flow control (i.e., the spool) position. In other embodiments, the first orifice 104 can be a variable orifice controlled by pilot pressure or controlled electronically by a controller (not shown) of the PCLS hydraulic system 10. In still other embodiments, the first orifice 104 can be a fixed orifice that provides continuous limiting, or restriction, of the downstream fluid flow.

The compensator 106 can be biased into a normally closed position. In some embodiments, the compensator 106 can be biased into the normally closed position by a spring 107 and/or a pressure from a load sense conduit 534. Once a pressure downstream of the first orifice 104 and upstream of the compensator 106 is greater than the pressure provided by the spring 107 and the load sense conduit 46, the compensator 106 can be biased into an open position, as shown in FIG. 9. This operation of the compensator 106 maintains a desired pressure downstream of the first orifice 104 to be substantially equal to the pressure at the load sense port 32. The fluid source 14 maintains a desired pressure upstream of the first orifice 104 to be substantially equal to the pressure at the load sense port 32 plus the margin pressure, so in combination with the fluid source 14, the first orifice 104 can have pressure drop substantially equal to the margin pressure.

The supply flow control 40 can include a load sense line 108, a secondary line 110, a first check valve 112, and a second check valve 114. The load sense line 108 communicates the pressure at a location downstream of the compensator 106 to the load sense conduit 46 through a load sense check valve 116. The load sense conduit 46 then communicates the pressure at the location downstream of the compensator 106 to the load sense port 32 of the fluid source 14. The pressure at the location downstream of the compensator 106 can be the pressure at a workport of the directional and return flow control 38 (i.e., the spool). The load sense check valve 116 can inhibit fluid flow in the load sense line 108 from the load sense conduit 46 to the location downstream of the compensator 106.

The secondary line 110 can provide a path for fluid to flow through a secondary line orifice 118 and the first check valve 112. Specifically, the secondary line 110 can provide a path for fluid to flow from the secondary supply conduit 54 to a location downstream of the compensator 106 and the second check valve 114. The secondary line orifice 118 can be a variable orifice that can be metered on the directional and return flow control (i.e., the spool). In other embodiments, the secondary line orifice 118 can be a variable orifice controlled by pilot pressure or controlled electronically by a controller (not shown) of the PCLS hydraulic system 10. In still other embodiments, the secondary line orifice 118 can be a fixed orifice that provides continuous limiting, or restriction, of the downstream fluid flow. The secondary line 110 can be used when full compensation is not desired for certain multifunction situations. The first check valve 112 can be arranged downstream, as shown, or can be arranged upstream of the secondary line orifice 118 and can inhibit fluid flow from the directional and return flow control 38 to the secondary supply conduit 54. The second check valve 114 can be arranged downstream of the compensator 106 and upstream of the directional and return flow control 38. The second check valve 114 can inhibit fluid flow from the directional and return flow control 38 to the compensator 106.

The load sense line 108 can communicate the pressure downstream of the compensator 106 and upstream of the second check valve 112 to the load sense conduit 46. This communicates the operating pressure, or load, of each of the working units 18, 20, and 22 to the load sense port 32 via the load sense conduit 46. Thus, the fluid source 14 can increase or decrease its displacement to maintain the margin pressure in response to changes in the highest load of any of the functions 24, 26, and 28. The load sense check valve 116 of each of the working units 18, 20, and 22 can result in the pressure in the load sense conduit 46 being connected to the highest load function.

During operation of the embodiment of the PCLS hydraulic system 10 of FIG. 3 with the supply flow control 40 and the supply flow section 50 of FIG. 9 integrated into the PCLS hydraulic system 10, fluid is output by the fluid source 14 into the supply conduit 34 which then can be commanded by one or more of the functions 24, 26, and 28 by actuating the corresponding directional and return flow control 38 (i.e., the spool). In one non-limiting example, the functions 24, 26 and 28 can be commanded simultaneously during the operation of the mobile machine with the functions 24 and 26 functions operating at a higher pressure than the function 28. In this embodiment of FIG. 3 with the supply flow control 40 and the supply flow section 50 of FIG. 9 integrated into the PCLS hydraulic system 10, a function can be designed to route flow from both the supply conduit 34 and the secondary supply conduit 54 in order to satisfy the flow requirements of the function. Once either of the function 24 or the function 26 is commanded (assuming the pilot pressures of the functions 24 and 26 are connected to the supply valve 100), the supply valve 100 can restrict the fluid flow through the secondary supply conduit 54. This restriction reduces or eliminates the ability of any function to consume flow from the secondary supply conduit 54, thus reducing its commanded flow. Since the commanded functions will then be fully compensated at a reduced command (i.e., the full flow command can be the flow expected from both the supply conduit 34 and the secondary supply conduit 54), the function 24 and the function 26 can receive a larger portion of the available pump flow than they would have if all the original function flow had come from the supply conduit 34.

Although the operation of the PCLS hydraulic system 10 was described above with reference to the specific non-limiting examples of multifunction operation, it should be known that limiting downstream functions via the supply valve 100 of the supply flow section 50 can be applied to other hydraulic systems with any number of functions and corresponding control valve units. In particular, the supply valve 100 can be incorporated into other embodiments of the invention described herein.

Figure 10:
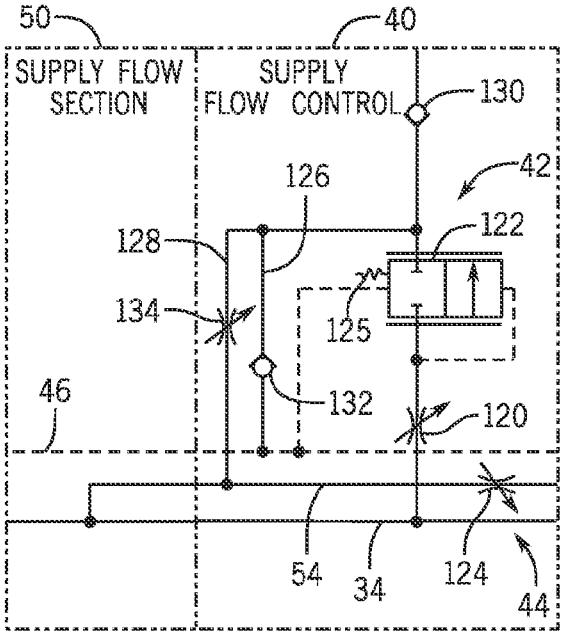
FIG. 10 shows a schematic illustration of a supply flow section and a supply flow control to be integrated into the PCLS hydraulic system of FIG. 4 in accordance with another embodiment of the present disclosure.

FIG. 10 shows yet another embodiment of the supply flow control 40 and the supply flow section 50 that can be integrated into the embodiment of the PCLS hydraulic system 10 shown in FIG. 4. As shown in FIG. 10, the secondary supply conduit 54 tees off from the supply conduit 34 within the supply flow section 50.

The supply flow control 40 can include a first orifice 120 which can provide fluid communication between the supply conduit 34 and a compensator 122. The supply flow control 40 can also include a second orifice 124. In some embodiments, the first orifice 120 and/or the second orifice 124 can be a variable orifice that can be a function of the directional and return flow control 38 (i.e., the spool) position. In other embodiments, the first orifice 120 and/or the second orifice 124 can be a variable orifice controlled by pilot pressure or controlled electronically by a controller (not shown) of the PCLS hydraulic system 10. In still other embodiments, the first orifice 120 and/or the second orifice 124 can be a fixed orifice that provides continuous limiting, or restriction, of the downstream fluid flow. The second orifice 124 can be configured to limit or restrict fluid flow to downstream functions (i.e., the second orifice 124 of the working unit 18 can limit or restrict fluid flow to functions 26 and 28, and so on). This can be achieved by the second orifice 124 being arranged upstream from and in series with the first orifice 120 of downstream working units (i.e., the second orifice 124 of the working unit 18 can be arranged upstream from and in series with the first orifice 120 of the working unit 20, and so on).

The compensator 122 can be biased into a normally closed position. In some embodiments, the compensator 122 can be biased into the normally closed position by a spring 125 and/or a pressure from a load sense conduit 46. Once a pressure downstream of the first orifice 120 and upstream of the compensator 122 is greater than the pressure provided by the spring 125 and the load sense conduit 46, the compensator 122 can be biased into an open position, as shown in FIG. 10. This operation of the compensator 122 maintains a desired pressure downstream of the first orifice 120 to be substantially equal to the pressure at the load sense port 32. The fluid source 14 maintains desired pressure upstream of the first orifice 120 to be substantially equal to the pressure at the load sense port 32 plus the margin pressure, so in combination with the fluid source 14, the first orifice 120 can have pressure drop substantially equal to the margin pressure.

The supply flow control 40 can include a load sense line 126, a secondary line 128, and a supply check valve 130. The load sense line 126 can communicate the pressure at a location downstream of the compensator 122 to the load sense conduit 46 through a load sense check valve 132. The load sense conduit 46 can then communicate the pressure at the location downstream of the compensator 122 to the load sense port 32 of the fluid source 14. The pressure at the location downstream of the compensator 122 can be the pressure at a workport of the directional and return flow control 38 (i.e., the spool). The load sense check valve 130 can inhibit fluid flow in the load sense line 126 from the load sense conduit 46 to the location downstream of the compensator 122.

The secondary line 128 can provide a path for fluid flow through a secondary line orifice 134. Specifically, the secondary line 128 can provide a path for fluid to flow from the secondary supply conduit 54 to a location downstream of the compensator 122. The secondary line orifice 134 can be a variable orifice that can be metered on the directional and return flow control (i.e., the spool). In other embodiments, the secondary line orifice 134 can be a variable orifice controlled by pilot pressure or controlled electronically by a controller (not shown) of the PCLS hydraulic system 10. In still other embodiments, the secondary line orifice 134 can be a fixed orifice that provides continuous limiting, or restriction, of the downstream fluid flow. The secondary line 128 can be used when full compensation is not desired for certain multifunction situations. The supply check valve 130 is arranged downstream of the compensator 122 and upstream of the directional and return flow control 38. The supply check valve 130 can inhibit fluid flow from the directional and return flow control 38 to the compensator 122.

The load sense line 126 can communicate the pressure downstream of the compensator 122 and upstream of the supply check valve 130 to the load sense conduit 46. This communicates the operating pressure, or load, of each of the working units 18, 20, and 22 to the load sense port 32 via the load sense conduit 46. Thus, the fluid source 14 can increase or decrease its displacement to maintain the margin pressure in response to changes in the highest load of any of the functions 24, 26, and 28. The load sense check valve 132 of each of the working units 18, 20, and 22 can result in the pressure in the load sense conduit 46 being connected to the highest load function.

During operation of the embodiment of the PCLS hydraulic system 10 of FIG. 4 with the supply flow control 40 and the supply flow section 50 of FIG. 10 integrated into the PCLS hydraulic system 10, fluid is output by the fluid source 14 into the supply conduit 34 which then can be commanded by one or more of the functions 24, 26, and 28 by actuating the corresponding directional and return flow control (i.e., the spool). In one non-limiting example, the functions 24, 26 and 28 can be commanded simultaneously during the operation of the mobile machine. In this embodiment of FIG. 4 with the supply flow control 40 and the supply flow section 50 of FIG. 10 integrated into the PCLS hydraulic system 10, a function can be designed to route flow from both the supply conduit 34 and the secondary supply conduit 54 in order to satisfy the flow requirements of the function. In this embodiment, once the second orifice 124 of any of the working units 18, 20, and 22 is caused to limit or restrict the fluid flowing therethrough, the secondary supply conduit 54 can be restricted downstream of the restricted second orifice 124. For example, if the second orifice of the working unit 20 is caused to limit or restrict the fluid flow therethrough, this restriction can reduce or eliminate the ability of any downstream functions (i.e., the function 28) to utilize flow from the secondary supply conduit 54, thus reducing its commanded flow. Since the downstream function (i.e., the function 28) will then be fully compensated at a reduced command (i.e., the full flow command can be the flow expected from both the supply conduit 34 and the secondary supply conduit 54), the upstream functions (i.e., the functions 24 and 26) can receive a larger portion of the available flow than they would have if all the original function flow had come from the supply conduit 34.

Although the operation of the PCLS hydraulic system 10 was described above with reference to the specific non-limiting examples of multifunction operation, it should be known that limiting downstream functions via the second orifice 124 of each of the working units 18, 20, and 22 can be applied to other hydraulic systems with any number of functions and corresponding control valve units. In the embodiment where the second orifice 62 of each of the working units 18, 20, and 22 are on the spool, the second orifices 62 of any of the working units 18, 20, and 22 can provide a different restriction for different directions of movement. For example, boom up versus boom down can have different priority requirements relative to swing.

It is to be understood that the invention is not limited in its application to the details of construction and the arrangement of components set forth in the preceding description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The preceding discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The preceding detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

Within this specification embodiments have been described in a way which enables a clear and concise specification to be written, but it is intended and will be appreciated that embodiments may be variously combined or separated without parting from the invention. For example, it will be appreciated that all preferred features described herein are applicable to all aspects of the invention described herein.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein.

Various features and advantages of the invention are set forth in the following claims.

We claim:

1. A hydraulic control valve assembly to be integrated into a pressure compensated load sensing hydraulic system including a fluid source having an outlet, the hydraulic control valve assembly comprising:

a first working unit to control a first hydraulic function of a machine and including a first directional and return flow control in the form of a first spool, a first function flow control to selectively communicate a working pressure of the first function to the fluid source, and a first downstream flow control;

a second working unit arranged downstream of the first working unit, the second working unit to control a second hydraulic function of the machine and including a second directional and return flow control in the form of a second spool and a second function flow control to selectively communicate a working pressure of the second function to the fluid source; and a supply conduit extending through the first working unit and the second working unit and in fluid communication with the outlet of the fluid source;

the fluid source to respond to a change in at least one of the working pressure of the first function and the working pressure of the second function by varying a pressure at the outlet;

the first downstream flow control to selectively restrict a flow of fluid from the fluid source to the second working unit.

2. The hydraulic control valve assembly of claim 1, further comprising a third working unit arranged downstream of the second working unit, the third working unit to control a third hydraulic function of the machine and including a third directional and return flow control in the form of a third spool and a third function flow control to communicate a working pressure of the third function to the fluid source.

3. The hydraulic control valve assembly of claim 2, wherein the second working unit further comprises a second downstream flow control to selectively restrict a flow of fluid from the fluid source to the third working unit.

4. The hydraulic control valve assembly of claim 1, wherein the first downstream flow control is arranged to selectively restrict the flow of fluid in the supply conduit.

5. The hydraulic control valve assembly of claim 1, wherein the first downstream flow control is a variable orifice.

6. The hydraulic control valve assembly of claim 5, wherein the variable orifice is controlled as a function of the directional and return flow control.

7. The hydraulic control valve assembly of claim 5, wherein the variable orifice is controlled by a pilot pressure.

8. The hydraulic control valve assembly of claim 5, wherein the variable orifice is controlled by an electrical signal.

9. The hydraulic control valve assembly of claim 1, wherein the first downstream flow control is a fixed orifice.

10. The hydraulic control valve assembly of claim 1, wherein the first downstream flow control is arranged downstream of a first orifice of the first working unit.

11. The hydraulic control valve assembly of claim 1, further comprising a secondary supply conduit extending from the supply conduit, the secondary supply conduit extending through the first working unit and the second working unit.

12. The hydraulic control valve assembly of claim 11, the first downstream flow control is arranged to selectively restrict the flow of fluid in the secondary supply conduit.

13. The hydraulic control valve assembly of claim 11, wherein the first working unit further comprises a compensator and a secondary line providing a path for fluid to flow from the secondary supply conduit to a location downstream of the compensator.

14. The hydraulic control valve assembly of claim 13, wherein the secondary line includes a secondary line orifice.

15. The hydraulic control valve assembly of claim 14, wherein the secondary line orifice is a variable orifice controlled by a function of the direction and return flow control.

16. A hydraulic control valve assembly to be integrated into a pressure compensated load sensing hydraulic system including a fluid source having an outlet, the hydraulic control valve assembly comprising:

a first working unit to control a first hydraulic function of a machine and including a first directional and return flow control in the form of a first spool and a first function flow control to control a flow of fluid to the first function and selectively communicate a working pressure of the first function to the fluid source;

a second working unit arranged downstream of the first working unit and to control a second hydraulic function of the machine, the second working unit including a second directional and return flow control in the form of a second spool and a second function flow control to control a flow of fluid to the second function and selectively communicate a working pressure of the second function to the fluid source;

a supply conduit extending through the first working unit and the second working unit and in fluid communication with the outlet of the fluid source; and a supply flow section including a downstream flow control, the downstream flow control to selectively restrict a flow of fluid from the fluid source to at least one of the first working unit and the second working unit;

the fluid source to respond to a change in at least one of the working pressure of the first function and the working pressure of the second function by varying a pressure at the outlet.

17. The hydraulic control valve assembly of claim 16, wherein the supply flow section is arranged downstream of the first working unit and upstream of the second working unit.

18. The hydraulic control valve assembly of claim 17, wherein the downstream flow control comprises a supply control valve and a flow limiting line, the flow limiting line providing a path for fluid to flow from a location upstream of the supply control valve to a location downstream of the supply control valve.

19. The hydraulic control valve assembly of claim 18, wherein the supply control valve is controlled by a pilot pressure.

20. The hydraulic control valve assembly of claim 18, wherein the supply control valve is controlled by an electrical signal.

21. The hydraulic control valve assembly of claim 18, wherein the flow limiting line includes a flow limiting line orifice arranged upstream of and in fluid communication with a supply compensator.

22. The hydraulic control valve assembly of claim 17, wherein the downstream flow control comprises a supply control valve arranged upstream of a compensator.

23. The hydraulic control valve assembly of claim 22, wherein the supply control valve is controlled by a pilot pressure.

24. The hydraulic control valve assembly of claim 22, wherein the supply control valve is controlled by an electrical signal.

25. The hydraulic control valve assembly of claim 16, wherein the supply flow section is arranged upstream of the first working unit.

26. The hydraulic control valve assembly of claim 25, further comprising a secondary supply conduit extending from the supply conduit, the secondary supply conduit extending through the first working unit and the second working unit.

27. The hydraulic control valve assembly of claim 26, wherein the downstream flow control comprises a supply control valve to restrict fluid flow into the secondary supply conduit.

28. The hydraulic control valve assembly of claim 27, wherein the supply control valve is controlled by a pilot pressure.

29. The hydraulic control valve assembly of claim 27, wherein the supply control valve is controlled by an electrical signal.

30. The hydraulic control valve assembly of claim 26, wherein the first working unit further comprises a compensator and a secondary line providing a path for fluid to flow from the secondary supply conduit to a location downstream of the compensator.

31. The hydraulic control valve assembly of claim 30, wherein the secondary line includes a secondary line orifice.

32. The hydraulic control valve assembly of claim 31, wherein the secondary line orifice is a variable orifice controlled by a function of the direction and return flow control.

33. A hydraulic control valve assembly to be integrated into a pressure compensated load sensing hydraulic system including a fluid source having an outlet, the hydraulic control valve assembly comprising:

a first working unit to control a first hydraulic function of a machine and including a first directional and return flow control in the form of a first spool, a first function fluid path to selectively communicate a working pressure of the first function to the fluid source, a first compensator, and a first variable downstream flow control orifice, the first spool including a first variable spool orifice;

a second working unit arranged downstream of the first working unit, the second working unit to control a second hydraulic function of the machine and including a second directional and return flow control in the form of a second spool, a second function fluid path to selectively communicate a working pressure of the second function to the fluid source, and a second compensator, the second spool including a second variable spool orifice; and a supply conduit extending through the first working unit and the second working unit and in fluid communication with the outlet of the fluid source;

the fluid source to respond to a change in at least one of the working pressure of the first function and the working pressure of the second function by varying a pressure at the outlet;

the first variable downstream flow control orifice is arranged in series with and upstream of the second variable spool orifice and selectively restricts a flow of fluid from the fluid source to the second working unit.

34. The hydraulic control valve assembly of claim 33, wherein the first variable downstream flow control orifice is controlled by a position of the first spool.

35. The hydraulic control valve assembly of claim 33, wherein the first variable downstream flow control orifice is controlled by a pilot pressure.

36. The hydraulic control valve assembly of claim 33, wherein the first variable downstream flow control orifice is controlled by an electrical signal.

37. The hydraulic control valve assembly of claim 33, further comprising a first compensator bypass line providing a path for fluid to flow from a location upstream of the first compensator to a location downstream of the first compensator.

38. The hydraulic control valve assembly of claim 37, wherein the first compensator bypass line include a first bypass orifice.

39. The hydraulic control valve assembly of claim 38, wherein the first bypass orifice is a variable orifice.

40. The hydraulic control valve assembly of claim 39, wherein the first bypass orifice is controlled by a position of the first spool.

41. The hydraulic control valve assembly of claim 33, further comprising a second compensator bypass line providing a path for fluid to flow from a location upstream of the second compensator to a location downstream of the second compensator.

42. The hydraulic control valve assembly of claim 41, wherein the second compensator bypass line include a second bypass orifice.

43. The hydraulic control valve assembly of claim 42, wherein the second bypass orifice is a variable orifice.

44. The hydraulic control valve assembly of claim 43, wherein the second bypass orifice is controlled by a position of the second spool.

* * * * *